United States Patent [19]

Beck

[11] 4,124,158

[45] Nov. 7, 1978

[54] PARTITION ARRANGEMENT

[75] Inventor: Robert E. Beck, Chicago, Ill.

[73] Assignee: Container Corporation of America, Chicago, Ill.

[21] Appl. No.: 869,423

[22] Filed: Jan. 16, 1978

[51] Int. Cl.[2] ..... B65D 5/48

[52] U.S. Cl. ..... 229/15; 229/28 R

[58] Field of Search ..... 229/15, 27, 28, 42; 217/31, 32

[56] References Cited

U.S. PATENT DOCUMENTS

| | | | |
|---|---|---|---|
| 3,236,433 | 2/1966 | Barrett et al. | 229/15 |
| 3,963,169 | 6/1976 | Gardner | 229/28 R |
| 4,000,844 | 1/1977 | Weimer | 229/15 |
| 4,030,659 | 6/1977 | Gardner | 229/15 X |

*Primary Examiner*—Davis T. Moorhead

*Attorney, Agent, or Firm*—Carpenter & Ostis

[57] ABSTRACT

An internal partition formed from a paperboard blank adapted to nest with a similar blank on a rectangular sheet of paperboard.

1 Claim, 3 Drawing Figures

PARTITION ARRANGEMENT

SUMMARY OF THE INVENTION

This invention relates to internal partitions for packages and more particularly to an internal partition of relatively simple design and construction which may be formed from a paperboard blank designed to nest closely with a similar blank to utilize a minimum amount of paperboard.

It is an object of this invention to provide a partition of the type described which includes a pair of longitudinal panels and a transverse panel which form four internal cells.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
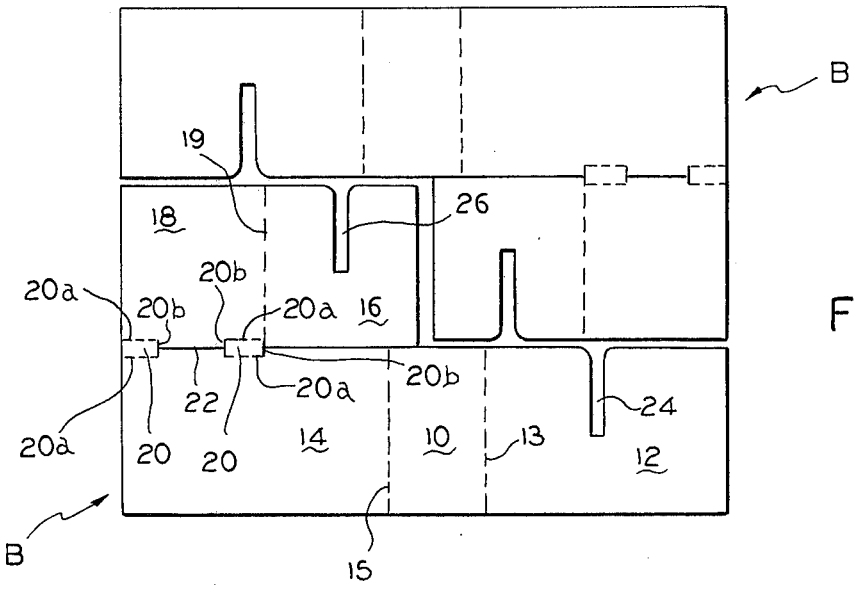
FIG. 1 is a plan view of a pair of blanks of the type from which the partition illustrated in the other views may be formed.
Figure 2:
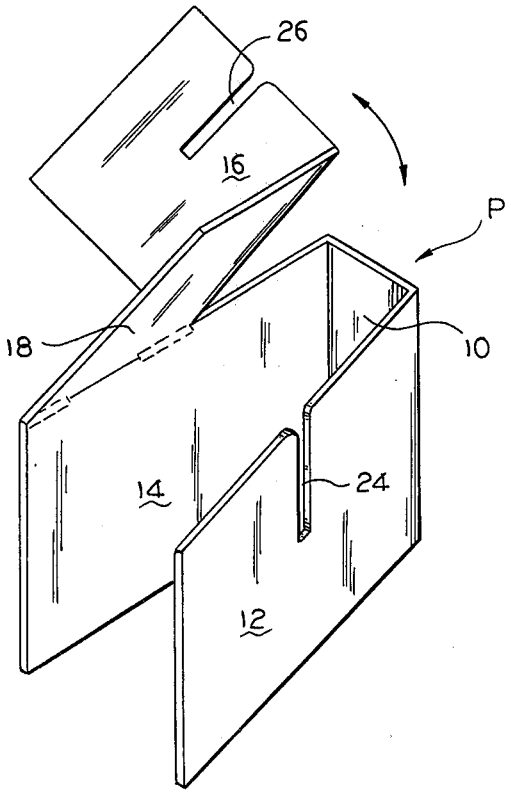
FIG. 2 is a fragmentary perspective view illustrating the manner in which the partition illustrated in FIG. 3 is formed.
Figure 3:
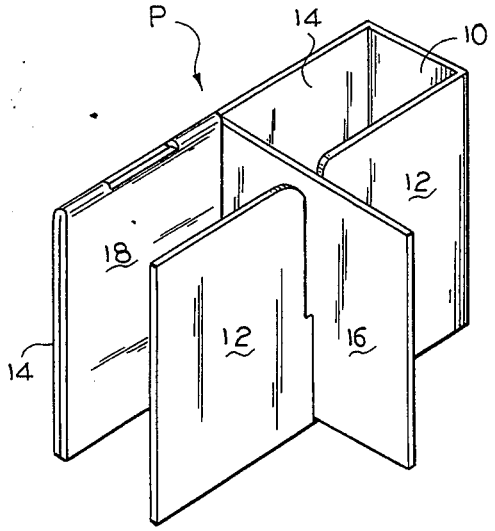
FIG. 3 is a fragmentary perspective view of a partition embodying features of the invention, as seen in the completely erected condition.

Referring now to the drawings for a better understanding of the invention, it will be seen that the partition P illustrated in FIGS. 2 and 3 may be formed from a unitary blank B of foldable sheet material illustrated in FIG. 1.

It will be noted that the blank B is of a novel design that utilizes a minimum amount of paperboard, and is so arranged that it will nest very closely with a similar blank to form a rectangular configuration. Thus an absolute minimum amount of waste is required in the formation of the blank.

Partition P includes a vertically disposed end panel 10 and a pair of first and second longitudinal panels 12 and 14 having corresponding end edges foldably joined to opposed side edges of panel 10 along fold lines 13 and 15, respectively. Longitudinal panels 12 and 14 have substantially the same overall dimensions and are spaced from each other in parallel relation.

In addition to being connected to each other by end panel 10, longitudinal panels 12 and 14 are also interconnected by means of a vertically disposed transverse panel 16 which is preferably of the same height as end panel 10 and the longitudinal panels.

Transverse panel 16 is foldably joined along one side edge to an inboard side edge of a connecting panel 18 along a fold line 19.

Connecting panel 18 is also preferably of the same height as the other panels of the partition but is of approximately one-half the length of panel 14. Connecting panel 18 is foldably joined at its upper edge to the upper edge of second longitudinal panel 14 by a pair of longitudinally spaced hinge connections 20 which are separated from each other by a cut line 22. Connecting panel 18 is folded to lie against the inner face of second longitudinal panel 14 and the hinge connections 20, each of which comprise a pair of spaced fold lines **20*a* and 20*b***, facilitate the folding of the connecting panel into such position.

It will be noted that first longitudinal panel 12 and transverse panel 16 are provided with upwardly and downwardly facing slots 24 and 26, respectively, which afford interlocking engagement therebetween to provide a rigid partition structure.

I claim:

1. An internal vertical partition structure open at its top and bottom and formed of a unitary blank of foldable paperboard comprising:

(a) a pair of first and second longitudinal panels of substantially similar size spaced from each other in parallel relationship;

(b) an end panel foldably joined at opposite side edges to corresponding end edges of respective longitudinal panels and extending transversely therebetween;

(c) a connecting panel foldably joined at its upper edge to an upper edge of said second longitudinal panel and folded to lie against a portion of the inner surface thereof;

(d) said connecting panel being of the same height as but of substantially less length than said second longitudinal panel;

(e) a transverse panel foldably joined along one side edge to an adjacent inboard side edge of said connecting panel and being disposed to extend normal to said longitudinal panels and beyond said first longitudinal panel;

(f) said transverse panel and said first longitudinal panel having complementary slots to provide interlocking engagement therebetween.

* * * * *